United States Patent [19]

Jagielski

[11] Patent Number: 4,712,495

[45] Date of Patent: Dec. 15, 1987

[54] CHAIN-STITCHING AND BLIND-STITCHING MACHINE FOR POINT-SEWING ARTICLES

[75] Inventor: Johannes Jagielski, Gladbeck, Fed. Rep. of Germany

[73] Assignee: J. Strobel & Sohne GmbH & Co., Fed. Rep. of Germany

[21] Appl. No.: 855,388

[22] Filed: Apr. 24, 1986

[30] Foreign Application Priority Data

Apr. 26, 1985 [DE] Fed. Rep. of Germany ..... 3515189

[51] Int. Cl.[4] ..... D05B 1/24; D05B 57/04

[52] U.S. Cl. ..... 112/176; 112/35; 112/201

[58] Field of Search ..... 112/104, 176, 178, 201, 112/267.1, 315, 35

[56] References Cited

U.S. PATENT DOCUMENTS 3,286,667 11/1966 Roth ..... 112/176

FOREIGN PATENT DOCUMENTS 707969 7/1941 Fed. Rep. of Germany ..... 112/176
2120558 11/1972 Fed. Rep. of Germany ..... 112/176
493426 10/1938 United Kingdom ..... 112/178

*Primary Examiner*—Wm. Carter Reynolds
*Attorney, Agent, or Firm*—Bacon and Thomas

[57] ABSTRACT

A chain-stitch blind stitch sewing machine having an arcuate needle to oscillate about an axis such that it passes through material to be sewn. An adjustable stitch loosening finger is attached to the sewing machine such that its position may be adjusted between a thread engaging position and a non-operative position. In its thread engaging position, the finger contacts the thread during the formation of each chain-stitch between two entry sites of the needle to form an additional free thread loop. A relatively loosely sewn point is thereby obtained. When the finger is in its non-operative position, the thread between the two entry sites will rest against the material being sewn to form a tightly sewn point.

6 Claims, 5 Drawing Figures

CHAIN-STITCHING AND BLIND-STITCHING MACHINE FOR POINT-SEWING ARTICLES

The invention concerns a chain-stitch blind-stitch sewing machine for sewing material at separate points with a predetermined number of stitches at each point.

Such sewing machines are used, for instance, to fix labels to clothing, ties, caps, covers and the like, to fix linings, hems, collars, trouser cuffs and trouser waistbands, and to stretch collars and hems in furs. The material being sewn is not advanced or fed, but instead the arcuate needle is displaced laterally between the individual successive stitches in order to alternatingly pierce the material being sewn at two different sites which are spaced from each other along a line parallel to the sewing axis of the arcuate needle. When a preselected number of stitches has been made, the sewing machine automatically stops sewing the thread being cut and the sewing machine returning into its initial state so that a new point can be sewn (German patent No. 35 15 189).

It is known to provide these sewing machines with a stitch loosening finger in order to obtain especially loosely sewn points. The stitch loosening finger is stationarily mounted to project toward the material being sewn on that side of the bulge former which is facing the needle swing axis so that every time the arcuate needle enters the material being sewn it will receive the sewing thread extending from the other entry site to this particular one. This thread portion will not come to rest on the material being sewn but instead on the stitch loosening finger so that an additional and free thread loop is obtained between the two entry sites, which assures a particularly loosely sewn point.

The main object of the invention is to create a sewing machine of the type as defined above which is improved in the simplest possible manner to extend the field of use and which allows to sew points selectively comparatively tightly and comparatively loosely. Furthermore, this looseness is adjustable to different values.

Even though the invention is especially intended for sewing machines of the type mentioned, nevertheless it also provides the same advantages with sewing machines producing a continuous blind stitched chain-stitch seam and wherein the arcuate needle is not displaced laterally, but instead the material being sewn is advanced or fed stepwise perpendicularly to that plane wherein the arcuate needle swings to and fro along a circular path concentric with the needle swing axis. The stitch loosening finger adjustable according to the invention between a first, thread pickup position and a second, non-operative position is arranged in such a way that it points toward the material being sewn between the last entry site and the next entry site of the arcuate needle, into the material being sewn, the next entry site resulting from the advance or feed step following the last arcuate needle swing through the material being sewn. The stitch loosening finger extends on that side of the bulge caused by the bulge former from where the arcuate needle enters the curved material being sewn.

An embodiment of the sewing machine of the invention is described below by way of example in conjunction with drawings in which.

Figure 3:
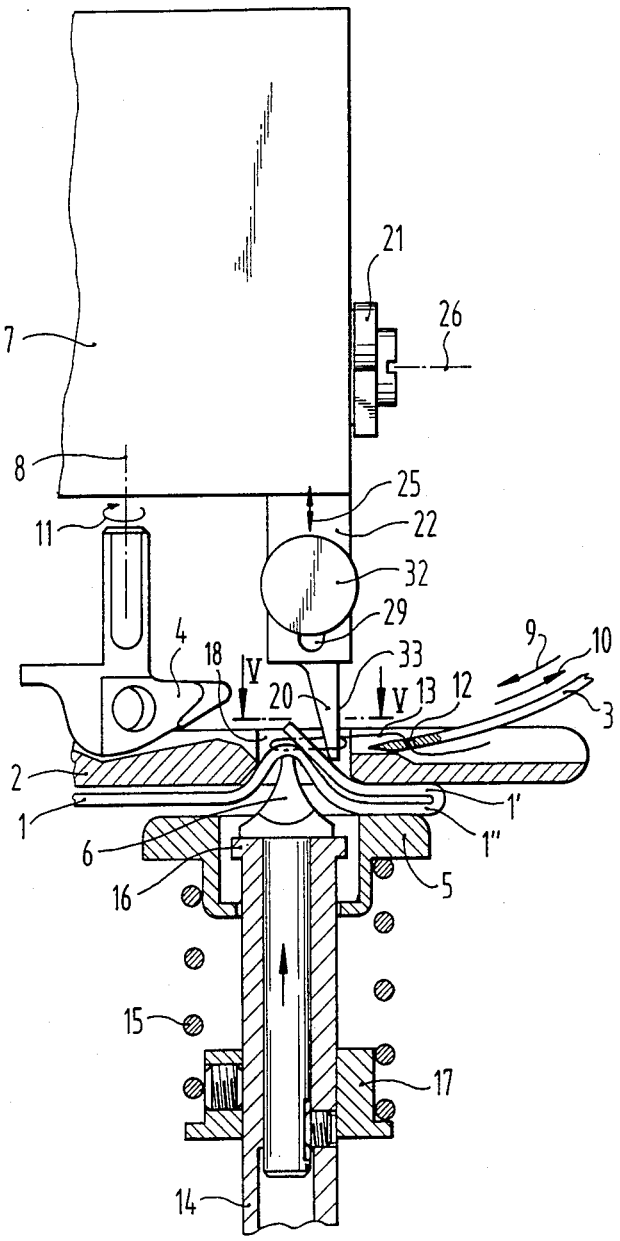
FIG. 3 is a view similar to FIG. 2 showing a point being sewn using the stitch loosening finger which is in the thread pickup position.
Figure 4:
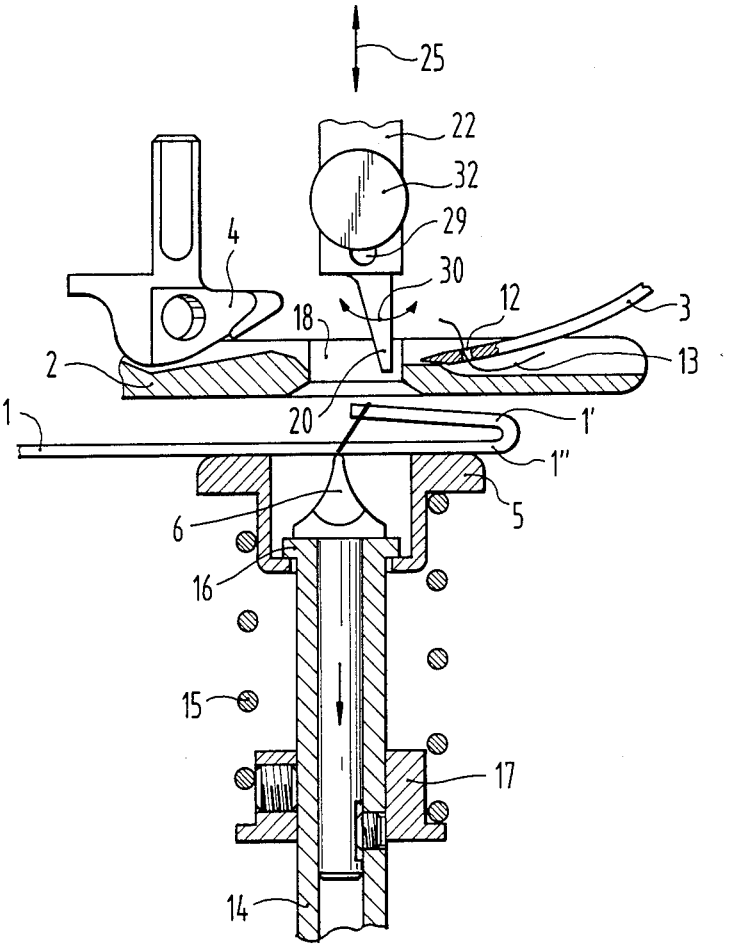
Figure 5:
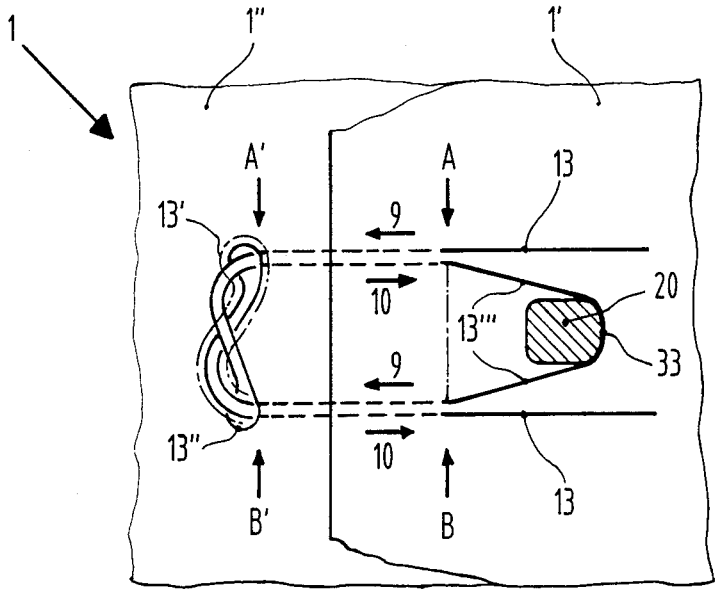

FIG. 4 is a partial view similar to FIG. 3 showing the sewing operation being terminated and both a presser and a bulge former of the sewing machine being lowered and the sewing thread between the material sewn and the arcuate needle being severed so that the material sewn can be moved for sewing at a new point or so that it may be removed from the sewing machine; and, FIG. 5 is a section taken along line V—V of FIG. 3 shown on a larger scale.

The chain-stitch blind stitch sewing machine shown in the drawings for sewing a material 1 at distinct points comprises a contacting plate 2, an arcuate needle 3, a looper 4, a presser 5 and a bulge former 6.

Figure 1:
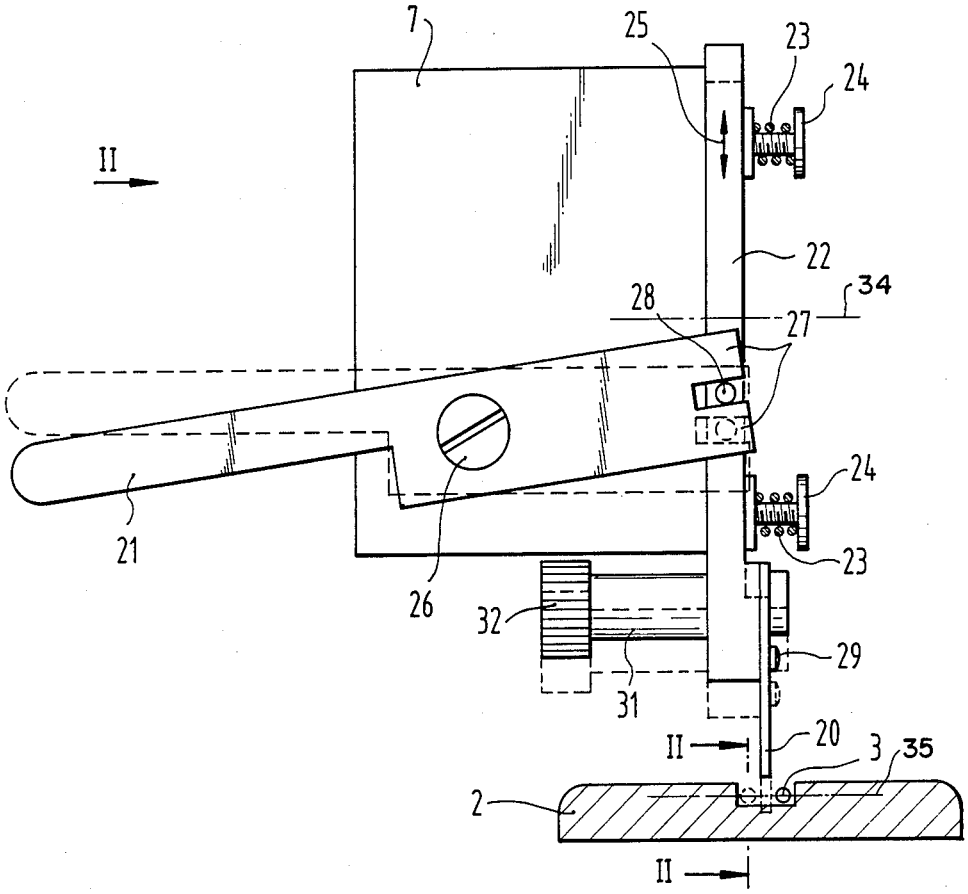
FIG. 1 is a view in the direction of arrow 1 of FIG. 2 and shows a portion of a machine head and a stitch loosening finger mounted to it and, the section along line I—I of FIG. 2 of a contacting plate of the sewing machine, the stitch loosening finger being shown in a non-operative position by solid lines and its thread pick up position being indicated by dashed lines.
Figure 2:
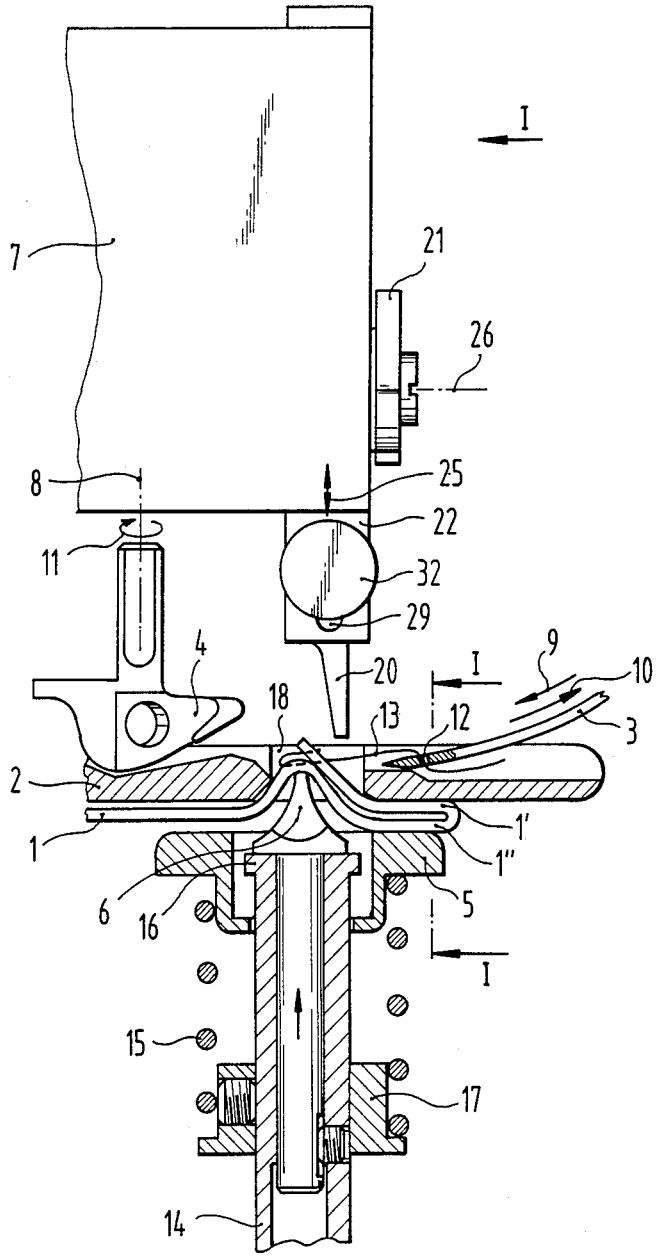
FIG. 2 is a view in the direction of arrow II of FIG. 1 of the machine head portion, the stitch loosening finger, and the contacting plate section taken along line II—II of FIG. 1 in the course of sewing a point without using the stitch loosening finger which is in the non-operative position.

The contacting plate 2 is horizontally mounted to a machine head of which only a portion 7 is shown and which is provided with a needle lever (not shown) swinging to and fro about an axis 34 parallel to the contacting plate 2 and perpendicular to the plane of each of the drawings of FIGS. 2 through 4 and further with the looper 4 which is supported to rotate about an axis 8 perpendicular to the contacting plate 2. The arcuate needle 3 is fastened to the free end of the needle lever in order to swing during each swing cycle of the needle lever parallel to the plane of each of the drawings of FIGS. 2 through 4 along a circular path concentric with the needle lever pivot axis 34 in the directions of arrows 9 and 10 of FIGS. 2 and 3 in to-and-fro manner. Namely, it swings toward the looper 4 and then away from it, said looper 4 rotating synchronously with the swinging arcuate needle 3 in the direction of arrow 11 of FIGS. 2 and 3 about the axis 8 so that jointly with the arcuate needle 3 it will concatenate a sewing thread 13 passing through an eyelet 12 to form chain stitches. In addition, the arcuate needle 3 alternates laterally between the two positions shown in FIG. 1 along line 35 to swing in each of the two positions in the directions of arrows 9 and 10, the needle lever supporting the arcuate needle 3 being laterally displaced correspondingly.

The plate-shaped presser 5 is displaceably mounted on a shaft 14 of the bulge former 6 and is spring loaded by a helical compression spring 15 toward an outer annular flange 16 of the shaft 14, this spring being clamped between the presser 5 and an adjustable ring 17 on the shaft 14. The shaft 14 is mounted to a machine arm (not shown) which supports the material 1 to be sewn, so that the shaft 14 can be displaced between the two positions shown in FIGS. 2 and 3 on the one hand and in FIG. 4 on the other hand, whereby the material 1 to be sewn is pressed during the sewing operation by the presser 5 against the side of the contacting plate 2 which is away from the arcuate needle 3 and from the looper 4 and is bulged by the bulge former 6 through an aperture 18 of the contacting plate 2 into the path of the arcuate needle 3, as shown in FIGS. 2 and 3, or else after the sewing operation it is released, as shown in FIG. 4. When the material 1 is sewn at a point, the arcuate needle 3 makes a pre-selected number of stitches, without advancing or feeding the material 1 being sewn, and thereupon the sewing machine will automatically stop sewing and, while the thread 13 between the arcuate needle 3 and the material 1 sewn is cut, will return into its initial state so that a new point can be sewn. The material 1 sewn is released automatically by driving the presser 5 and the bulge former 6 into the positions shown in FIG. 4.

The sewing machine includes a stitch loosening finger 20 which is manually adjustable using a double-armed actuation lever 21 between a first, thread pickup position and a second, non-operative position as indicated in FIGS. 2 and 3 respectively. The stitch loosening finger 20 is mounted to a support or slide 22 which is pressed by two helical compression springs 23 against the machine head portion 7 along which it is displaceable perpendicularly to the contacting plate 2 and against which it engages frictionally, so that it is kept reliably by this friction in any position into which the slide 22 has been set by means of the actuation lever 21. The two helical compression springs 23 are seated on the shanks of two bolts 24 screwed into the machine head portion 7, said shanks each passing through an elongated slot of the slide 22 extending in its direction of motion indicated by double arrow 25 of FIGS. 1 through 4.

The actuation lever 21 is supported on the machine head portion 7 for rotation about an axis 26 perpendicular to the direction of motion 25 of the slide 22 and to the needle lever pivot axis (not shown) and engages with its right bifurcated end 27 a lateral pin 28 of the slide 22, as shown in FIG. 1.

The stitch loosening finger 20 is supported on the slide 22 to rotate about an axis 29 parallel to the needle lever pivot axis, whereby it can be pivoted on the slide 22 in the direction of double arrow 30 of FIG. 4. Moreover, the slide 22 is provided with a clamping screw 31 to fix the stitch loosening finger 20 in the particular position into which it has been pivoted on the slide 22. The clamping screw 31 is provided with an actuation knob 32 so that it can be manually actuated to clamp the stitch loosening finger 20 against the slide 22 and respectively to release said clamping.

The stitch loosening finger 20 is formed as a plate having in the area projecting from the end of the slide 22 adjacent to the contacting plate 2 the contour of a narrow but alongated quadrangle tapering from the slide 22 toward the contacting plate 2 as indicated in FIGS. 2 through 4. The slide 22 supporting the stitch loosening finger 20 is so mounted to the machine head portion 7 that according to FIGS. 2 through 4 the stitch loosening finger 20 points toward the material 1 located in or below the aperture 18 of the contacting plate 2 on that side of the bulge former 6 from where the arcuate needle 3 in the sewing operation pierces the material 1 bulged by the bulge former 6, as shown in FIGS. 2 and 3, and on which the needle lever pivot axis is located. According to FIG. 1, the stitch loosening finger 20 is furthermore so mounted that it extends centrally between those two planes in each of which the arcuate needle 3 during the sewing operation swings to and fro in the directions of arrows 9 and 10, whereby the arcuate needle 3 alternatingly passes on one side or the other the stitch loosening finger 20 during the sewing operation when the stitch loosening finger 20 is lowered into the first thread pickup position, as can be seen from FIGS. 3 and 5.

The stitch loosening finger 20 will be set into the first, thread pickup position shown in FIG. 3, when a relatively loose sewing at a point of material 1 is desired. The effect then obtained by the stitch loosening finger 20 results especially clearly from FIG. 5 illustrating the manufacture of a loosely sewn point to fasten an upper fabric layer 1' to a lower fabric layer 1". When sewing the point with a pre-selected number of stitches, the arcuate needle 3, as already mentioned, will shift laterally in order to pierce the material 1 being sewn and bulged according to FIG. 3 by the bulge former 6 toward the arcuate needle 3, the looper 4 and the stitch loosening finger 20 in alternating manner at two sites A and B which are mutually spaced along a line parallel to the needle lever pivot axis.

When the arcuate needle 3 enters the material 1 being sewn at the site A of FIG. 5 so as to move in the direction of arrow 9 through the two fabric layers 1' and 1" until the tip with the eyelet 12 exits at site A' from the lower fabric layer 1" and passes through a loop 13' of the thread 13 formed by the previous stitch and held by the looper 4, and then returns in the direction of arrow 10 through the two fabric layers 1' and 1" and leaves the material 1 being sewn at the entry site A, then a new thread loop 13" held by the looper 4 is obtained. After it has left the material 1 being sewn, the arcuate needle 3 shifts laterally downward as shown in FIG. 5, on that side of the stitch loosening finger 20 which is away from the entry sites A and B, so as to now enter the material 1 being sewn at the site B, the thread 13 resting against the longitudinal edge 33 of the stitch loosening finger 20 which is away from the two entry sites A and B. Again the arcuate needle 3 then moves in the direction of arrow 9 through the two fabric layers 1' and 1" until its tip with the eyelet 12 exits from the lower fabric layer 1" at site B' and passes through the thread loop 13" held by the looper 4, whereupon the arcuate needle 3 returns in the direction of arrow 10 through the two fabric layers 1' and 1" to leave the material 1 being sewn at the entry site B. A new thread loop 13' results from this stitch which is superimposed on or extends along the previous thread loop 13', as indicated in FIG. 5 by a dash-dotted line.

Accordingly the stitch loosening finger 20 provides that during the formation of each chain-stitch, the portion of the thread 13 which is located between the two entry sites A and B forms an additional and free thread loop 13"40 , whereby a relatively loosely sewn point is obtained, as results furthermore from FIG. 4. This looseness furthermore is adjustable, namely by a corresponding adjustment of the length of the thread loops 13"' between the two entry sites A and B of the arcuate needle 3 into the material 1 being sewn, the described adjustable mounting of the stitch loosening finger 20 to the slide 22 serving that purpose.

The stitch loosening finger 20 will be set into the second, non-operative position shown in FIG. 2, when a tighter sewing at a point of material 1 is desired. In that position the stitch loosening finger 20 will be ineffective and accordingly it cannot pick up the thread 13 which thereby during the sewing operation will rest between the two entry sites A and B of the arcuate needle 3 against the material 1 being sewn, as indicated by a dashed line in FIG. 5. Because of the absence of the additional free thread loop 13"', the point sewn without using the stitch loosening finger 20 will be tighter.

I claim:

1. A chain-stitch blind stitch sewing machine having a machine head for sewing material at separate points with a predetermined number of stitches at each point and comprising:

(a) a contacting plate having an aperture;

(b) a presser disposed on a first side of said contacting plate for pressing the material being sewn against the contacting plate;

(c) a bulge former disposed on said first side of said contacting plate for bulging the material being sewn into said contacting plate aperture;

(d) an arcuate needle disposed on a second side of said contacting plate so as to oscillate about a first axis extending generally parallel to the contacting plate and to be laterally displaceable for alternately piercing the bulged material being sewn at two sites mutually spaced along a line extending generally parallel to said first axis;

(e) a rotating looper disposed on said second side of said contacting plate for cooperation with said swinging arcuate needle to form chain-stitches;

(f) a slide disposed on said second side of said contacting plate and adjustably attached to the machine head;

(g) a stitch loosening finger disposed on the second side of the contacting plate and projecting toward the material being sewn between said two sites on the side thereof from which said arcuate needle pierces the material being sewn for picking up sewing thread portions extending between the two sites;

(h) means to rotatably attach said stitch loosening finger to said slide such that it may pivot about a second axis extending generally parallel to the first axis;

(i) clamping means interposed between said slide and said stitch loosening finger to clamp the stitch loosening finger in a desired position on the slide to provide a corresponding length of sewing thread portions; and, (j) actuation means to displace said slide between two positions on the machine head so as to set said stitch loosening finger into a first, thread pick-up position and a second, non-operative position.

2. Sewing machine per claim 1 wherein the clamping means comprises a clamping screw having an actuation knob.

3. Sewing machine per claim 1 wherein the slide is adjustably displaceable in a direction generally perpendicular to the contacting plate.

4. Sewing machine per claim 3, wherein the slide frictionally bears against the machine head.

5. Sewing machine per claim 4, further comprising at least one compression spring biasing the slide against the machine head.

6. Sewing machine per claim 3, further comprising a double arm actuation lever rotatably supported on the machine head so as to pivot about a third axis extending generally perpendicular to the first axis and having an end engaging the slide such that pivoting the arm about the third axis adjusts the position of the slide on the machine head.

* * * * *

UNITED STATES PATENT AND TRADEMARK OFFICE

CERTIFICATE OF CORRECTION

PATENT NO. : 4,712,495

DATED : Dec. 15, 1987

INVENTOR(S) : JAGIELSKI

It is certified that error appears in the above—identified patent and that said Letters Patent is hereby corrected as shown below:

In Col. 1, line 22, delete "No. 35 15 189" and add --application publication 21 20 558--.

In Col. 3, line 33, delete "(not shown)".

In Col. 4, line 50, delete "13"40"and add--13'"--.

Signed and Sealed this

Nineteenth Day of July, 1988

*Attest:*

DONALD J. QUIGG

*Attesting Officer*

*Commissioner of Patents and Trademarks*